US009840074B2

(12) United States Patent
Bastici et al.

(10) Patent No.: US 9,840,074 B2
(45) Date of Patent: Dec. 12, 2017

(54) METHOD AND DEVICE FOR REPLACING THE PRINTING ROLLER OF A PRINTING UNIT OF A PRINTING MACHINE

(71) Applicant: BOBST FIRENZE S.R.L., Campi Bisenzio (Florence) (IT)

(72) Inventors: Massimo Bastici, Crema (IT); Federico D'Annunzio, Florence (IT); Giacomo Maccalli, Lodi (IT); Mauro Maccalli, Lodi (IT)

(73) Assignee: BOBST FIRENZE S.R.L., Campi Bisenzio (Florence) (IT)

( * ) Notice: Subject to any disclaimer, the term of this patent is extended or adjusted under 35 U.S.C. 154(b) by 0 days.

(21) Appl. No.: 15/306,171

(22) PCT Filed: Apr. 28, 2015

(86) PCT No.: PCT/IB2015/053085
§ 371 (c)(1),
(2) Date: Oct. 24, 2016

(87) PCT Pub. No.: WO2015/166409
PCT Pub. Date: Nov. 5, 2015

(65) Prior Publication Data

US 2017/0043570 A1 Feb. 16, 2017

(30) Foreign Application Priority Data

Apr. 29, 2014 (IT) ..... M12014A0784

(51) Int. Cl.
*B41F 13/24* (2006.01)
*B41F 27/06* (2006.01)
(Continued)

(52) U.S. Cl.
CPC ..... *B41F 27/06* (2013.01); *B41F 5/24* (2013.01); *B41F 13/20* (2013.01); *B41F 13/30* (2013.01);
(Continued)

(58) Field of Classification Search
CPC ..... B41F 5/00; B41F 5/24; B41F 7/00; B41F 9/00; B41F 9/18; B41F 13/0024;
(Continued)

(56) References Cited

U.S. PATENT DOCUMENTS 5,692,442 A * 12/1997 Leanna ..... B41F 5/24 101/247
5,906,162 A * 5/1999 Kolbe ..... B41F 5/24 101/216

(Continued)

FOREIGN PATENT DOCUMENTS

| | | |
|---|---|---|
| DE | 4413807 C1 | 9/1995 |
| EP | 14622254 A1 | 9/2004 |
| WO | 2009144016 A1 | 12/2009 |

OTHER PUBLICATIONS

International Search Report and Written Opinion for International Application No. PCT/IB2015/053085 (10 Pages) (dated Jul. 30, 2015).

*Primary Examiner* — Leslie J Evanisko
*Assistant Examiner* — Marissa Ferguson Samreth
(74) *Attorney, Agent, or Firm* — Lucas & Mercanti, LLP

(57) ABSTRACT

The present invention relates to a device for replacing the printing roller in a printing unit, in particular for in line rotary flexographic machines.

14 Claims, 4 Drawing Sheets

(51) Int. Cl.

| | |
|---|---|
| ***B41F 5/24*** | (2006.01) |
| ***B41F 13/20*** | (2006.01) |
| ***B41F 13/30*** | (2006.01) |
| ***B41F 13/40*** | (2006.01) |
| ***B41F 27/10*** | (2006.01) |

(52) U.S. Cl.
CPC ..... *B41F 13/40* (2013.01); *B41F 27/105* (2013.01); *B41P 2217/15* (2013.01); *B41P 2227/21* (2013.01)

(58) Field of Classification Search
CPC ..... B41F 13/16; B41F 13/20; B41F 13/24; B41F 13/30; B41F 13/34; B41F 13/40; B41F 27/05; B41F 27/06; B41P 2217/15; B41P 2227/21
See application file for complete search history.

(56) References Cited

U.S. PATENT DOCUMENTS

| | | | | |
|---|---|---|---|---|
| 6,247,406 | B1 * | 6/2001 | D'Annunzio ..... | B41F 13/24 101/153 |
| 6,318,257 | B1 * | 11/2001 | Niemiro ..... | B41F 13/14 101/212 |
| 6,408,756 | B1 * | 6/2002 | D'Annunzio ..... | B41F 13/20 101/216 |
| 2002/0108520 | A1 * | 8/2002 | Kolbe ..... | B41F 5/24 101/479 |

* cited by examiner

METHOD AND DEVICE FOR REPLACING THE PRINTING ROLLER OF A PRINTING UNIT OF A PRINTING MACHINE

CROSS-REFERENCE TO RELATED APPLICATIONS

This application is a 371 of PCT/IB2015/053085, filed Apr. 28, 2015, which claims the benefit of Italian Patent Application No. MI2014A000784, filed Apr. 29, 2014.

TECHNICAL FIELD OF THE INVENTION

The present invention relates to a device for replacing the printing roller in a printing unit, in particular for in-line rotary flexographic machines.

BACKGROUND OF THE INVENTION

At present, in the printing sector, and in particular in the sector of printing labels and flexible wrappings, there exists a very urgent need to increase the general efficiency of the printing processes, on the one hand reducing the printing time and on the other hand limiting the wastage of material, such as the printing medium.

In particular, the step of changing the printing rollers is one of the most critical steps in the entire printing process since the so-called "job change-over" times constitute downtime, during which the printing process is substantially interrupted. Moreover, the change-over between two different printing jobs generally results in a huge amount of wasted material.

Some solutions for automatically changing the printing rollers are known. For example reference is made to international publication WO2009/144016. This describes a printing machine associated with a device which performs replacement of the printing roller with a new one. This device comprises gripping means displaceable on a guide for gripping the used printing roller, depositing it in a suitable store, gripping a new printing roller and then arranging it in the working position. This device is constructionally complex and bulky. Moreover, replacement of the printing roller is relatively slow because it requires successive and consequent movements of the same gripping element.

SUMMARY OF THE INVENTION

The object of the present invention is to provide a device for replacing the printing rollers of a printing unit, in particular for in-line rotary flexographic machines, which solves the technical problems described above, allowing an increase in the efficiency and the productivity of the printing processes.

In connection with this task, one object of the present invention is to provide a device for replacing the printing rollers of a printing unit which is able to achieve a reduction in the "job change-over" time and the amount of wasted material associated with this "job change-over" operation.

A further object of the invention consists in providing a device for replacing the printing rollers of a printing unit which is able to provide greater guarantees as regards reliability and safety during use.

Another object of the invention consists in providing a device for replacing the printing rollers of a printing unit which is easy to produce and competitive from a cost point of view when compared with the prior art.

Yet another object of the present invention is to provide a device which performs replacement of the printing roller quickly and which at the same time is constructionally simple and has compact dimensions.

These results are achieved by the device for replacing the printing roller in a printing unit, in particular for in-line rotary flexographic machines according to the present invention, the essential characteristic features of which are described, respectively, in the independent claim 1 and in the independent method claim 12. Further important characteristic features are also described in the dependent claims.

BRIEF DESCRIPTION OF THE DRAWINGS

The characteristic features and advantages of the device and the associated method according to the present invention will become apparent from the following detailed description of preferred embodiments thereof, given as an example and not for limiting purposes, with reference to the attached drawings in which.

DETAILED DESCRIPTION OF THE INVENTION

Figure 1:
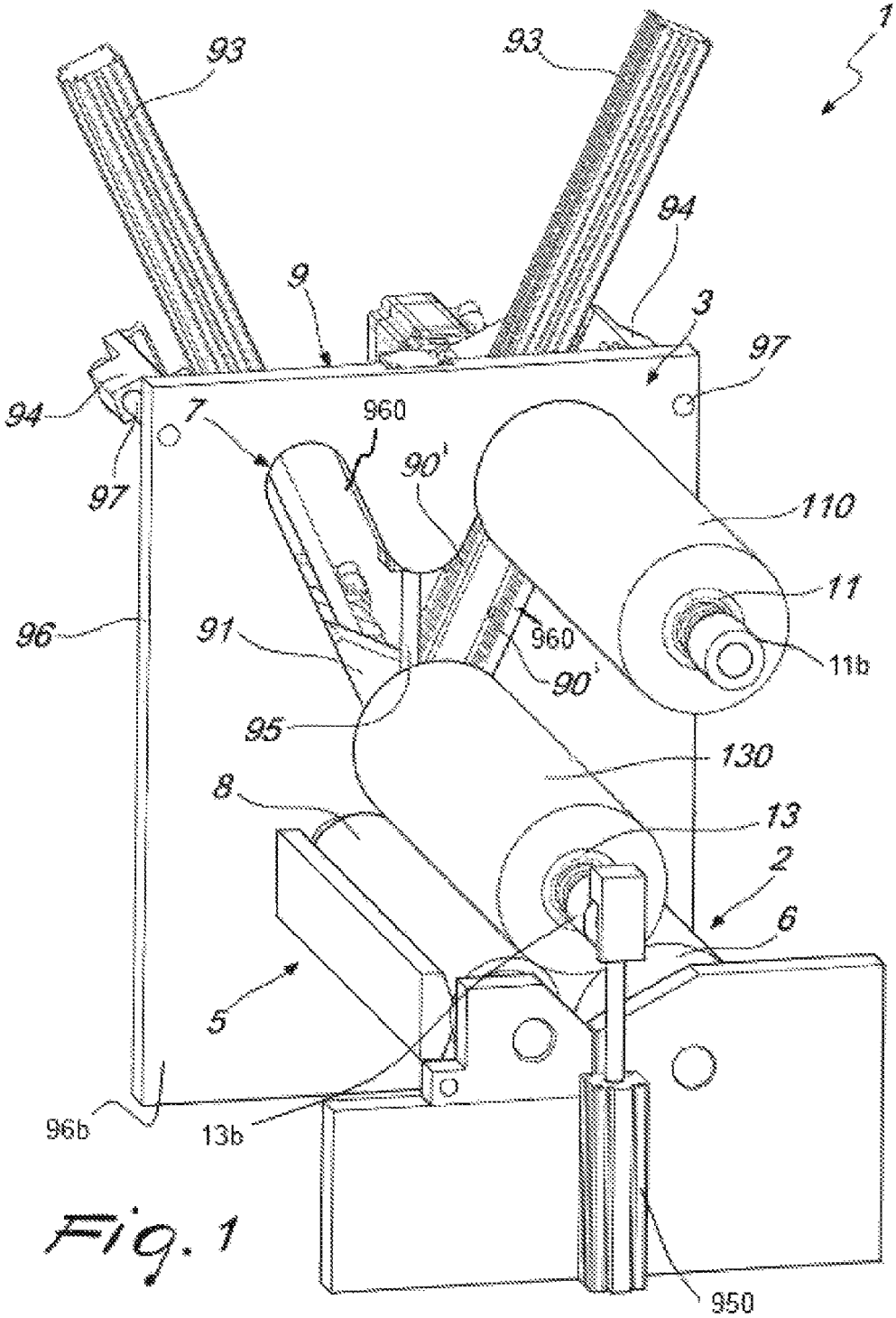
FIG. 1 is a first perspective view of an embodiment of a device for replacing the printing rollers of a printing unit, according to the invention.
Figure 2:
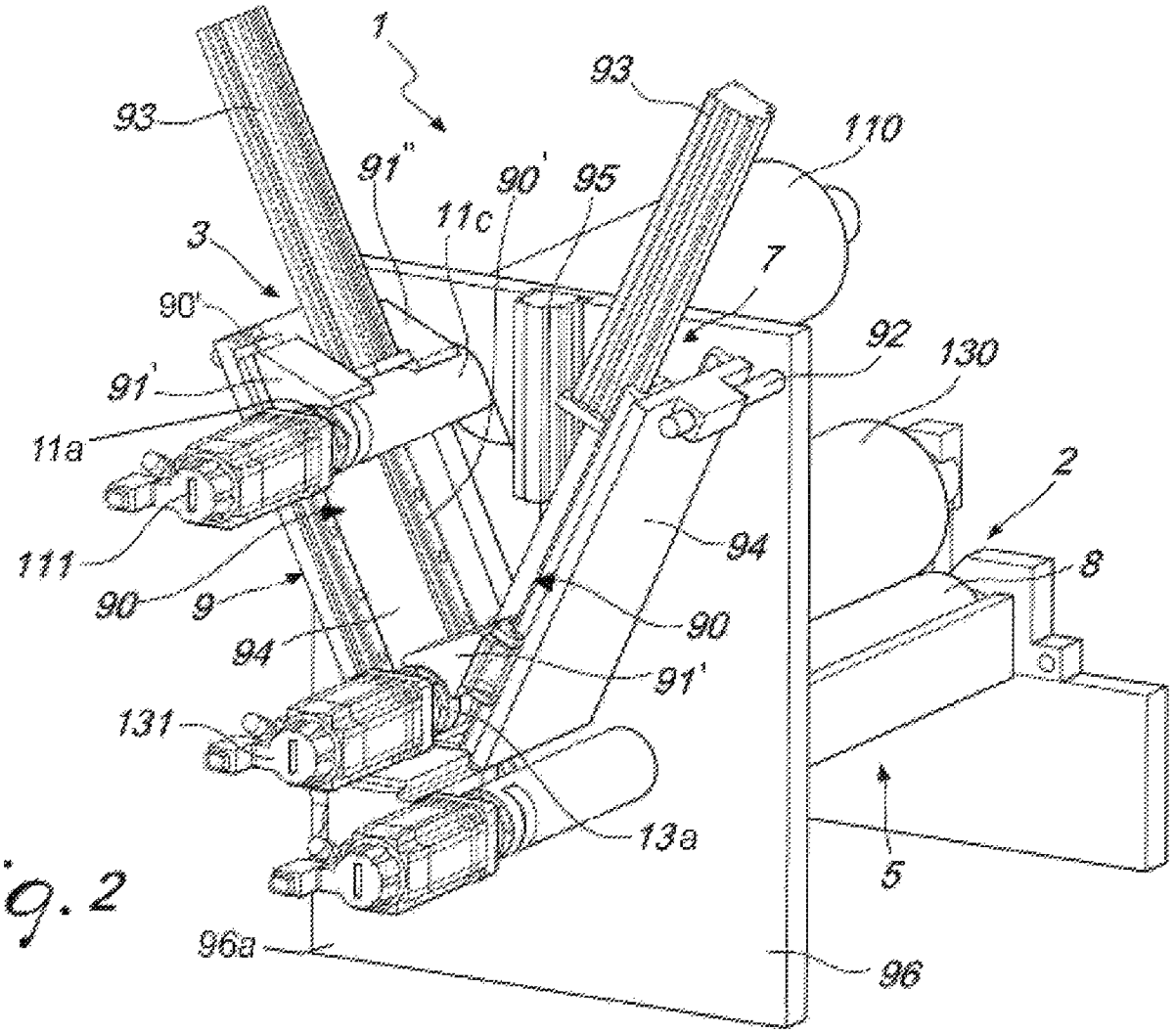
FIG. 2 is a second perspective view of the device shown in FIG. 1, according to the invention.

With reference to the aforementioned figures, the device for replacing the printing roller of a printing unit is denoted overall by the reference number 1, while the printing unit is denoted overall by the reference number 2 and comprises at least one anilox roll 8 and one counter-roll 6.

According to the invention, the device 1 comprises a work station 5 for a first working printing roller 130 associated with a first support spindle 13, a holding station 3, 7 for a second holding printing roller 110 associated with a second support spindle 11, a removal station 7, 3 for removing a printing roller 110, 130 to from a support spindle 11, 13, and displacement means 9 for displacing the first support spindle 13 from the work station 5 to the removal station 7, 3 and for displacing the second support spindle 11 from the holding station 3, 7 to the work station 5.

The work station is arranged in a substantially intermediate position between the removal station 7, 3 and the holding station 3, 7, as can be seen from the figures.

In the figures, the holding station is indicated by the reference number 3 and is occupied by the support spindle 11 which supports a held printing roller 110, while the removal station is indicated by the reference number 7 and is not temporarily occupied by any spindle since it is waiting to receive the support spindle 13 which supports the printing roller 130 currently in operation in the work station 5, when this printing roller 130 must be replaced. However, the station indicated by the reference number 3 may be a removal station, and the station indicated by the reference number 7 may be a holding station, namely the holding and removal stations may reverse their functions depending on the station which momentarily is not occupied.

In greater detail, each spindle has two ends, a first end 13*a*, 11*a* of which is connected to the displacement means, as will be described in detail below, and a second end 13*b*,

11*b* of which is designed to be connected to the means for performing locking in the working position, as will become clear further below. A first section of the spindle 13*c*, 11*c*, adjacent to the first end, is free, while the second section 13*d*, 11*d*, adjacent to the second end, is occupied by the printing roller.

Considering again the displacement means 9, these comprise advantageously a pair of guides 90, each of which extends between the work station and the removal station 7 and the holding station 3, respectively.

Each guide is defined by a rail 90' which has, slidably associated with it, a carriage 91 with which, in turn, the first support spindle 13, or the second support spindle 11, or a first end of said spindles, is rigidly associated.

In a preferred constructional version, each guide is defined by a pair of rails 90' and 90" parallel with each other and having two carriages 91 slidably associated therewith. Each spindle, or the first end thereof, is rigidly associated with the carriages. The presence of a double system of rails 90',90" and carriages 91 for each support spindle 11, 13 ensures greater stability for the displacements of said spindles between the work station 5 and the holding station 3 or removal station 5 and vice versa.

The displacement means 9 comprise, both for the holding station 3 and for the removal station 7, actuating means 93 configured to perform the displacement of each support spindle 11, 13 along the rails, owing to the sliding action allowed by the carriages 91. The actuating means 93 may be hydraulic or pneumatic pistons.

The displacement means 9 comprise advantageously, for the holding station 3 and the removal station 7, a pivoting plate 94 with which the guides 90 and the actuating means 93 are associated. Each pivoting plate 94 is hinged in the vicinity of the holding station 3 or removal station 7. In particular, this pivoting plate 94 is hinged, by means of a pivot pin 97, with a flat support structure 96 which supports the displacement means 9. The pivoting plate 94 has a top end located opposite the holding station 3 or removal station 7 and a bottom end located opposite the work station 5. Hinging of the support structure 96 by means of the pivot pin 97 is performed at the top end of the pivoting plate 94.

The support structure 96 takes the form of a flat plate in which two straight through-incisions 960 are formed.

The guides 90 are located on a first side 96*a* of the flat plate 96, while the first printing roller 130 and the second printing roller 110 project from an opposite side 96*b*. As a result the ends of the spindles are located on the opposite sides of the plate, and therefore the free section 11*c*, 13*c* of each spindle is arranged so as to straddle and pass through the respective incision. The guides 90 are arranged substantially along the respective incision and in particular along a bottom edge 960' thereof owing to the engagement of the spindle inside the incision and the aforementioned hinging arrangement.

Figure 3:
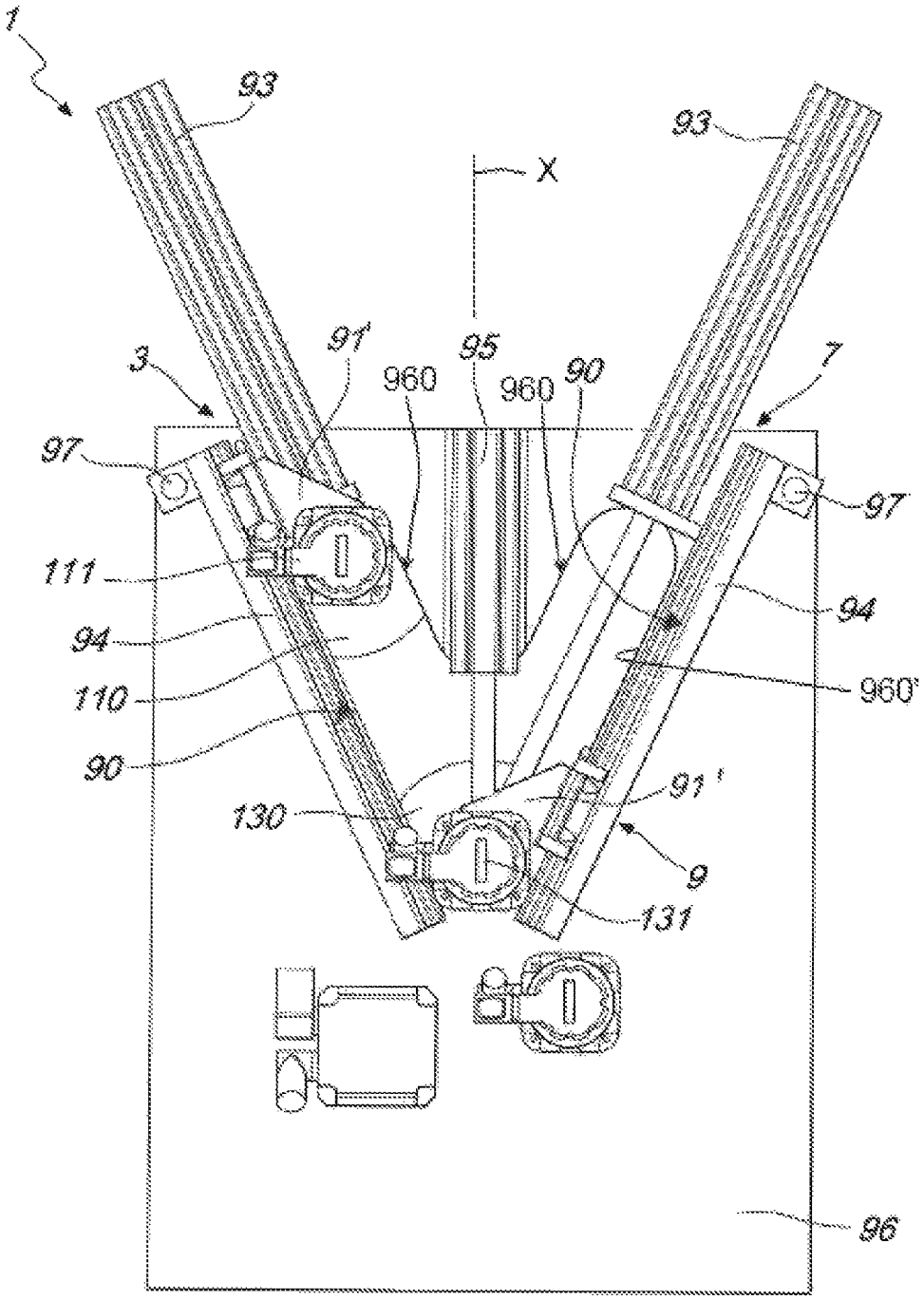
FIG. 3 is a back view of the device shown in FIG. 1, according to the invention.
Figure 4:
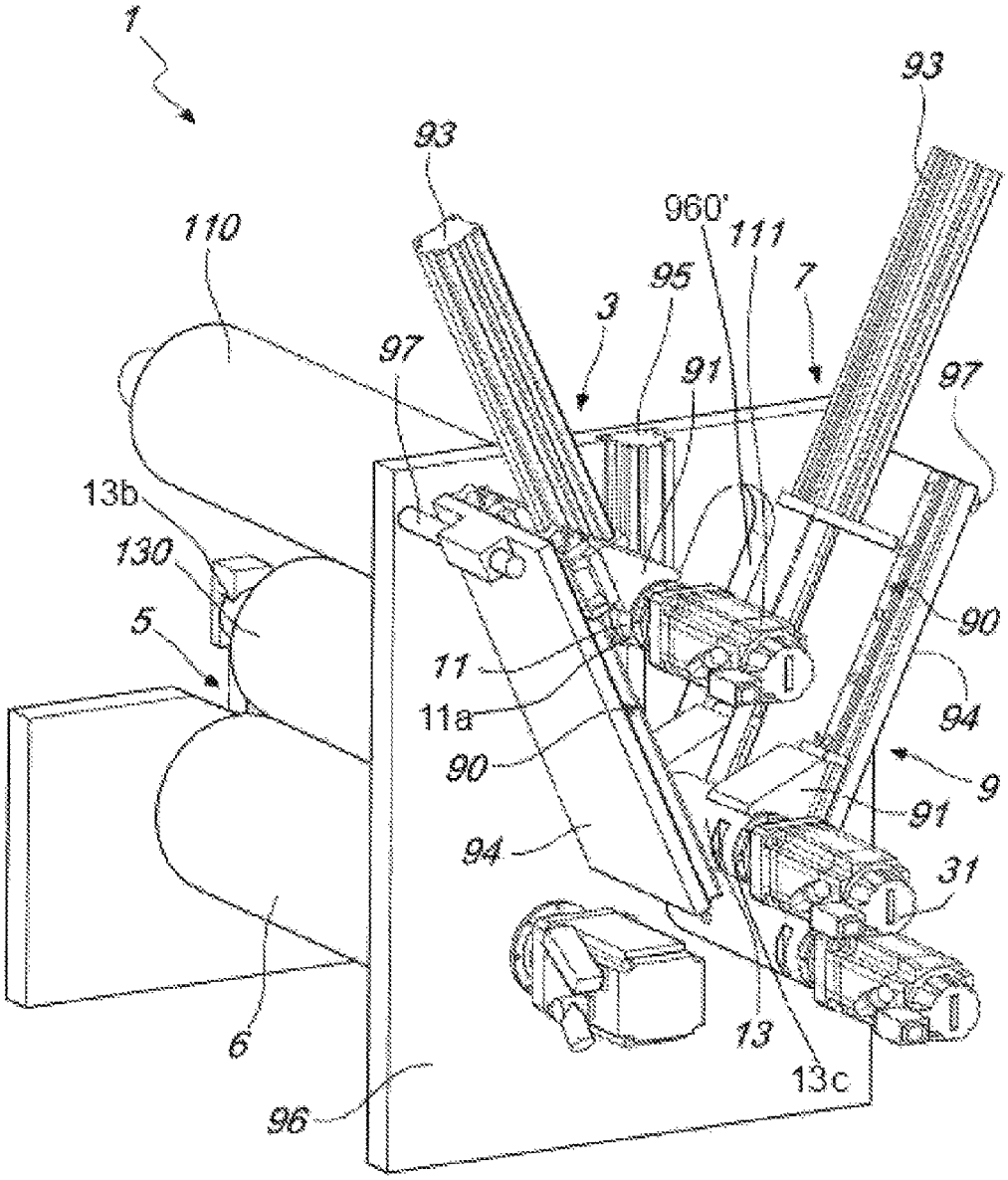
FIG. 4 is a third perspective view of the device shown in FIG. 1, according to the invention.

In the preferred constructional solution the incisions are arranged symmetrically inclined with respect to a vertical axis X (FIG. 3), defining a substantially V-shaped configuration (obviously the apex of the V corresponds to the working position). Consequently, the guides are also arranged in the form of a V relative to each other. This configuration is particularly advantageous because the device as a whole is compact and has a small volume.

However, it is also quite possible, in constructional variants, for the incisions, and to consequently the guides, to be arranged horizontally, extending in opposite directions from the work station in a symmetrical manner.

Furthermore, it is also possible for the incisions, and consequently the guides, to extend in opposite directions from the work station, but not symmetrically, with different inclinations.

The device 1 comprise finally thrusting means 95, 950 which are configured to press, along the axis X, the printing roller in the work station 5 against the anilox roll 8 and/or against the counter-roll 6 which form part of the printing unit 2, in order to define the maximum printing pressure. In the constructional solution shown in the figures, the thrusting means take the form of two actuators (of the pneumatic or oil-hydraulic type) which each act on one end of the spindle.

The method for replacing printing rollers of a printing unit 2, in particular for in-line rotary flexographic machines, according to the invention, comprises the steps of:

providing a first working printing roller 130 in a work station 5, associated with a first support spindle 13;

providing a second held printing roller 110 in a holding station 3, 7, associated with a second support spindle 11;

displacing, by means of the displacement means 9, the first support spindle 13 from the work station 5 to the removal station 7, 3 and displacing, again by means of the displacement means 9, the second support spindle 11, from the holding station 3, 7 to the work station 5;

removing the first printing roller 130 from the first support spindle 13, when the spindle 13 and the roller 130 are in the removal station 7, 3.

Moreover, the step of displacing the first support spindle 13 and the second support spindle 11 is advantageously performed without stopping the printing process and may also be advantageously performed at any stage of the printing process.

The operating principle of the device is clear and evident from the description provided above.

In particular, the device 1 allows a new printing roller 110 to be positioned on the printing spindle 11, in the holding station 3, while the working printing roller 13 in the work station 5 is completing the printing cycle. At the end of the printing step, the displacement means 9 cause displacement, along the guides 90, of the support spindle 13, the printing roller 130 of which was in operation, bringing it into the removal station 7, and at the same allow the displacement, along the guides 90, of the new printing roller 110 associated with the support spindle 11, which was on holding in the holding station 3, into the work station 5, in order to resume operation. During displacement, the spindle travels in contact along the bottom edge of the incision 960' until the printing roller supported by the spindle reaches the work position, namely at a tangent to the anilox cylinder and counter-roll. As a result, depending on the diameter of the printing roller, the displacement of the spindle stops in a position more or less advanced along the guide 90. In order to be properly seated in the working position the printing roller must engage inside the support cradles (not shown but known in the configuration of flexographic printing machines). This positioning arrangement may require an adjustment in the position of the printing roller also along the vertical axis X. The movement is therefore permitted by the fact that the guide may vary slightly its inclination with respect to said axis X, owing to the hinged arrangement.

As regards the pistons 93, in a preferred constructional solution, these push the carriage until the roller comes into contact with the cradle. In this maximum stroke position of the carriage, the piston has not yet reached its fully extended stroke. In general, during the entire stroke movement of the carriage along the guide, the piston does not reach the fully extended stroke. Obviously solutions may also be envisaged where stoppage of the piston is performed automatically.

Once the printing roller is in the working position the thrusting means 95, 950 are operated.

The above comments are also applicable, in an analogous manner, to the step of removal of the printing roller from the working position, namely during movement of the printing roller from the work position to the removal position. Obviously, before removal of the printing roller from the working position the thrusting means must be deactivated.

Once the worn printing roller has been removed from the spindle in the removal station it is possible to replace it with a new one, such that the removal station becomes in fact a holding station for the next working step of the device.

In the case where the device 1 is applied to all the printing units 2 of the printing machine, both selective and sequential changing of the printing rollers is permitted.

In the case of selective changing, if it is required to change only one printing roller (for example, in order to obtain a new text, a new language, etc.), the change may be performed instantaneously without any wastage of material due to machine stoppage and consequent loss of the printing register. The machine does not stop, the device 1 performs the change-over on the selected printing station, without losses or wastage of any type, immediately and perfectly in register.

In the case of sequential changing, instead, during the job change-over changing of the printing rollers is performed starting from a first printing unit, in which the "new" cylinder replaces the "old" cylinder, and starts to print the "new" job. The "old" job continues its path as far as a second printing unit and, when the "new" job arrives from the first printing unit, the "new" printing cylinder of the second unit takes over from the old cylinder, printing the second colour of the "new" job, perfectly in register with the first colour of the preceding job, without any wastage between "old" and "new" jobs. The "old" job thus continues its path as far as a third printing unit and, when the "new" printed job arrives from the first and second printing units, the "new" printing roller of the third unit takes over from the old roller, printing the third colour of the "new" job, perfectly in register with the first and second colours of the "new" job, without any wastage between "old" and "new" jobs. And so on, for all the successive printing units, the procedure continues with a sequential replacement of the "old" job with the "new" job without leaving wastage of material between the two jobs.

It has been established in practice how the device and the method for replacing a printing roller of a printing unit, according to the present invention, fulfil the task and achieve the predefined objects since they allow the efficiency of the printing process to be increased, reducing the job change-over time and reducing the amount of wasted material. In fact, changing of the printing rollers may be performed at a low speed, without stopping the flexographic machine. This allows the job change-overs to be performed without disturbing the tension of the printing medium, which continues to be driven, and therefore without loss of register, both in the "old" printed job and in the "new" printed job.

The device therefore achieves a series of not insignificant advantages, namely it increases the efficiency and the productivity of the printing process, while being constructionally simple and compact. Moreover, it provides ample guarantees as regards reliability and safety during use.

Also, the device is easy to produce and competitive from a cost point of view when compared to the prior art. Furthermore, in the particularly preferred constructional solution, it has compact overall dimensions. It is also suitable for installation on machines which are already in use.

The present invention has been described up to here with reference to its preferred embodiments. It should be understood that each of the technical solutions implemented in the preferred embodiments described here as an example can advantageously be combined differently with each other, to create other embodiments, which derive from the same inventive core, in any case within the scope of protection of the attached claims.

The invention claimed is:

1. A device for replacing a printing roller of a printing unit, comprising:

a work station for a first working printing roller associated with a first support spindle;

a holding station for a second held printing roller associated with a second support spindle;

a removal station for removing one of the first printing roller and the second printing roller from the support spindle;

said work station being arranged in a substantially intermediate position between said removal station and said holding station; and displacement means for displacing said first support spindle from said work station to said removal station and for displacing said second support spindle from said holding station to said work station;

said displacement means comprising two guides each of which extends from said work station as far as said holding station and said removal station, respectively, said first support spindle and second support spindle being slidably connected to said guides so as to allow the simultaneous displacement of said first printing roller from said work station to said removal station and of said second printing roller from said holding station to said work station, said device being characterized in that it comprises further comprising a support structure which defines two opposite sides, said displacement means being located on a first side, said first and second printing rollers projecting from a second side opposite to said first side, two through-incisions are formed in said support structure, said first spindle and second spindle being each arranged so as to pass through a respective incision so that a first end of each spindle projects from said first side in order to be connected to said displacement means, while a section of each support spindle projecting from said opposite side of said support structure is occupied by said each one of the first printing roller and said second printing roller.

2. The device according to claim 1, wherein one end of each of said guides close to the respective holding or removal station is hinged with said first side of said support structure.

3. The device according to claim 2, wherein each of said guides is composed of two parallel rails having, slidably associated with each of said guides, two carriages rigidly associated with said first end of said first support spindle and said second support spindle.

4. The device according to claim 3, wherein each pair of rails is associated with a pivoting plate, a hinging arrangement being formed on said pivoting plate.

5. The device according to claim 4, whereby, owing to said hinging arrangement and an engagement of said first and second spindles inside said respective through-incisions, each guide assumes a condition inclined substantially in accordance with said respective through-incisions, so that said guides are substantially inclined in a V configuration relative to each other.

6. The device according to claim 2, wherein said through-incisions are inclined relative to each other so as to define a substantially V-shaped configuration, said work station being arranged at an apex thereof.

7. The device according to claim 1, wherein said displacement means comprises an actuating means for displacing carriages along said respective guides.

8. The device according to claim 7, wherein said actuating means and a locking means are actuators of an oil-hydraulic or pneumatic type.

9. The device according to claim 1, further comprising locking means configured to press each one of said first printing roller and said second printing roller against an anilox roll and a counter-roll of said printing unit.

10. A flexographic printing machine, comprising a device of claim 1.

11. A method for replacing printing rollers of a printing unit, comprising the steps of:

providing a first working printing roller in a work station, associated with a first support spindle;

providing a second held printing roller in a holding station, associated with a second support spindle;

displacing, by means of displacement means, said first support spindle from said work station to a removal station and displacing at the same time, by means of said displacement means, said second support spindle from said holding station to said work station;

in said removal station removing one of the first printing roller and the second printing roller from said first support spindle; and wherein said displacement means comprising a pair guides each of which extends from said work station as far as said holding station and from said work station as far as said removal station, said first support spindle and second support spindle being slidably connected respectively to one of said guides, said displacement means also comprising actuating means configured to perform the independent displacement of each support spindle along the respective guide so as to allow the simultaneous displacement of said first printing roller from said work station to said removal station and of said second printing roller from said holding station to said work station, said displacement means further comprising a support structure which defines two opposite sides, said displacement means being located on a first side, said first and second printing rollers projecting from a second side opposite to said first side, two through-incisions are formed in said support structure, said first spindle and second spindle being each arranged so as to pass through a respective incision so that a first end of each spindle projects from said first side in order to be connected to said displacement means, while a section of said each support spindle projecting from said opposite side of said support structure is occupied by said each one of the first printing roller and said second printing roller.

12. The method according to claim 11, wherein said displacement of said first spindle from said work station to said removal station and simultaneously said displacement of said second support spindle from said holding station to said work station is performed by means of displacement on said respective two guides, owing to the action of actuating thrusting means.

13. The method according to claim 11, wherein, once said second spindle is in a working position, thrusting means are activated in order to press said second printing roller against an anilox cylinder and a counter-roll of said printing unit.

14. The method according to claim 13, wherein said thrusting means are deactivated so as to allow removal of said each one of the first printing roller and said second printing roller from said working position.

* * * * *